US008466763B2

(12) United States Patent
Lambourne et al.

(10) Patent No.: US 8,466,763 B2
(45) Date of Patent: Jun. 18, 2013

(54) ELECTROMAGNETIC DEVICE

(75) Inventors: Alexis Lambourne, Belper (GB); Geraint W Jewell, Sheffield (GB)

(73) Assignee: Rolls-Royce PLC, London (GB)

( * ) Notice: Subject to any disclaimer, the term of this patent is extended or adjusted under 35 U.S.C. 154(b) by 19 days.

(21) Appl. No.: 13/204,997

(22) Filed: Aug. 8, 2011

(65) Prior Publication Data

US 2012/0049990 A1 Mar. 1, 2012

(30) Foreign Application Priority Data

Aug. 24, 2010 (GB) ..... 1014107.5

(51) Int. Cl.
*H01F 7/00* (2006.01)

(52) U.S. Cl. ..... 335/301; 335/220

(58) Field of Classification Search ..... 335/277, 335/248

See application file for complete search history.

(56) References Cited

U.S. PATENT DOCUMENTS 4,081,776 A 3/1978 Hisamoto et al.

FOREIGN PATENT DOCUMENTS

GB 733718 7/1955
GB 1056412 1/1967

OTHER PUBLICATIONS

British Search Report issued in Application No. GB1014107.5 dated Dec. 13, 2010.

*Primary Examiner* — Elvin G Enad
*Assistant Examiner* — Lisa Homza
(74) *Attorney, Agent, or Firm* — Oliff & Berridge, PLC

(57) ABSTRACT

An electromagnetic device, which includes a ferromagnetic flux guide; an insulated electrical conductor positioned adjacent to the ferromagnetic flux guide; and, an intermediate support structure positioned between the ferromagnetic flux guide and conductor which includes at least one resiliently deformable member arranged to allow relative movement between the ferromagnetic flux guide and the insulated electrical conductor, in which the relative movement is due to thermal expansion or contraction of the ferromagnetic flux guide and insulated electrical conductor.

10 Claims, 2 Drawing Sheets

ELECTROMAGNETIC DEVICE

BACKGROUND

This invention relates to electromagnetic devices having encapsulated electrical conductors which are at least partially surrounded by a magnetic flux guide. In particular, this invention relates to electromagnetic devices which are used in high temperature environments.

There are many applications where it is desirable to have electromagnetic devices which can operate in harsh environments. For example, high temperature environments or environments which subject a high degree of vibration on a device. Such applications might include motors, generators, solenoids, valve actuators, pumps and control rod mechanisms etc in aero-engines or nuclear power plants.

Electromagnetic devices having a ferromagnetic flux guide and an electrical conductor insulated by a polymer are generally well known. However, high temperature applications require alternative electrical insulators to replace conventional polymeric materials to prevent electrical and mechanical breakdown at elevated temperatures. Possible replacement electrical insulators are ceramic materials.

Problems can arise with the use of ceramic insulators, and similar alternatives, due to a mismatch in the relative coefficients of thermal expansion of the ceramic and the material which forms the magnetic flux guide. The resulting mismatch in thermal expansion can lead to mechanical and electrical breakdown of the ceramic insulators. These problems are particularly significant in large machines where the differential thermal expansion is increased due to the general increase in the size of the constituent components. Coils produced with ceramic insulation and encapsulants also have significantly lower mechanical compliance than polymer based coils.

Ceramic insulators can also mechanically and electrically degrade when exposed to high levels of vibration over long periods of time, which can limit the applications such insulators can be employed in.

SUMMARY

The present invention seeks to address some of the problems of the prior art.

The present invention provides an electromagnetic device, comprising: a ferromagnetic flux guide; an insulated electrical conductor positioned adjacent to the ferromagnetic flux guide, wherein the insulation is a ceramic material; and, an intermediate support structure positioned between the ferromagnetic flux guide and insulated electrical conductor which includes at least one resiliently deformable member arranged to allow relative movement between the ferromagnetic flux guide and the insulated electrical conductor, in which the relative movement is due to thermal expansion or contraction of either or both the ferromagnetic flux guide and insulated electrical conductor.

The resiliently deformable members can take up varying degrees of differential thermal expansion between adjacent insulated electrical conductors and ferromagnetic flux guides in an electromagnetic device. In doing so, the potentially harmful stress which would otherwise be present at the interface of the constituent components after a significant temperature rise in the device, may be reduced. This may help prolong the lifetime of the device.

The intermediate support structure may also provide a degree of mechanical shock resistance for the adjacent parts when exposed to high levels of vibration.

The resiliently deformable members can extend between the electrical conductor and the ferromagnetic flux guide along an arcuate path. The resiliently deformable members can be straight. The resiliently deformable members can follow a curved path having multiple radii of curvature. The resiliently deformable members can follow a meandering path. Providing arcuate, curved or meandering resiliently deformable members may allow for a controlled elastic deformation of the members without buckling or irreversible plastic deformation of the intermediate support structure.

The insulated electrical conductor can be a coil. The coil can be elongate. The coil can be round or polygonal, regular or irregular in cross section. Preferably, the coil is cylindrical.

The insulated electrical conductor can be encapsulated. The encapsulating material can be ceramic. Suitable ceramic materials include $Al_20_3$, $Mg0_2$, MgO, $ZrO_2$ or a range of other ceramics as used in commercially available encapsulation materials (e.g. Resbond® 920) Ceramic insulating materials can generally withstand higher temperatures than polymeric wiring systems.

The electromagnetic device may be for use in temperatures in excess of 250° C. The electromagnetic device may have an electrical power in the range between 10 Watts and 500 kW. However, the skilled person will appreciate the invention may be applied to other power ranges where suitable. The diameter of the encapsulated coil may be in the range 20 mm to 0.5 m.

The resiliently deformable member can be stressed along the arcuate path so as to push against the insulated electrical conductor and ferromagnetic flux guide. In the case where the insulated electrical conductor is a coil, the pushing force may act to centre the coil within the ferromagnetic flux guide, which may advantageously create a frictional retaining force to prevent axial displacement of the coil.

The resiliently deformable members can extend substantially between a first point on the encapsulated coil and a second point on the ferromagnetic flux guide. The first and second points may be radially separated along a straight line which passes through the axis of the coil.

The or each resiliently deformable member can contact the insulated electrical conductor and ferromagnetic flux guide via contacting portions. In such an arrangement heat may flow from the insulated electrical conductor to the ferromagnetic flux guide via the resiliently deformable members in use.

The contacting portions can be integral to the or each resiliently deformable member. The contacting portions can have a rounded, polygonal or irregular contacting surface area.

Contacting portions can extend across multiple resiliently deformable members. Preferably, at least one contacting portion extends between two adjacent resiliently deformable members. Having the contacting portions that extend between two resiliently deformable members may allow heat from a unit surface area of the insulated electrical conductor to flow down multiple paths. This can provide a larger combined cross-sectional area than a single resiliently deformable member thereby increasing the heat flow from a single contacting portion.

The intermediate support structure can be an integral part of the ferromagnetic flux guide. Having the intermediate support structure as an integral part of the ferromagnetic flux guide may allow the assembly of the electromagnetic device to be simpler.

The intermediate support structure can be in the form of a sleeve which receives the insulated electrical conductor. The sleeve can be formed from a sheet material. The sheet material can have the resiliently deformable members formed thereon prior to formation of the sleeve. The sleeve can be a tube. The resiliently deformable members can be an integral part of the sleeve. Alternatively, the resiliently deformable members can be attached to the sheet material or tube by one of the group of welding, diffusion bonding and ultrasonic fusion.

The sheet material which forms the sleeve can be constructed from metal. Either or both of the contacting portions and the resiliently deformable members can be constructed from metal. Generally, metal provides a suitable material in terms of thermal conductivity and flexural rigidity for the intermediate supporting structure. Suitable metals for constructing the resiliently deformable members and contacting portions are aluminium, titanium and silicon steel, for example.

In the case where the insulated electrical conductor is an encapsulated coil, the sleeve can entirely encircle either or both of the outer and inner circumferential surfaces of the coil. Alternatively, the sleeve can partially encircle either or both of the outer and inner circumferential surfaces of the coil.

In the case when the electrical conductor is a elongate coil, the resiliently deformable members can run the length of the coil so as to maximise the surface contact between the coil and the ferromagnetic flux guide thereby improving heat flow from one to the other.

The intermediate support structure can include at least one non-conducting portion. The non-conducting portion may be arranged to prevent electrical currents circulating the circumference of the coil in the intermediate support structure, for example, when the energising current is time-varying or transient.

The sleeve can be of a corrugated construction having ridges and troughs. The ridges can be formed by two adjacent resiliently deformable members and an adjoining contacting portion which abuts the encapsulated coil. The troughs can include two adjacent resiliently deformable members and an adjoining contacting portion which abuts the ferromagnetic flux guide. A corrugated construction is relatively simple to form as a sheet material which can subsequently form the sleeve. The corrugated construction may also simplify construction of the contacting portions and resiliently deformable members.

The ridges and troughs can have a rounded profile. The contacting portions of the ridges and troughs can be curved about the axis of the coil so as to be coaxial. Having coaxial contacting portions for the ridges and troughs provides a relatively large contact surface area on the encapsulated coil and ferromagnetic flux guide such that heat flow from the encapsulated flux guide is more efficient.

The ridges and troughs of the corrugated sleeve can form ducts for cooling the encapsulated coil with a coolant. The coolant can be a gas or a liquid.

BRIEF DESCRIPTION OF THE DRAWINGS

Embodiments of the invention will now be described with the aid of the following figures in which.

DETAILED DESCRIPTION OF THE EMBODIMENTS

Figure 1:
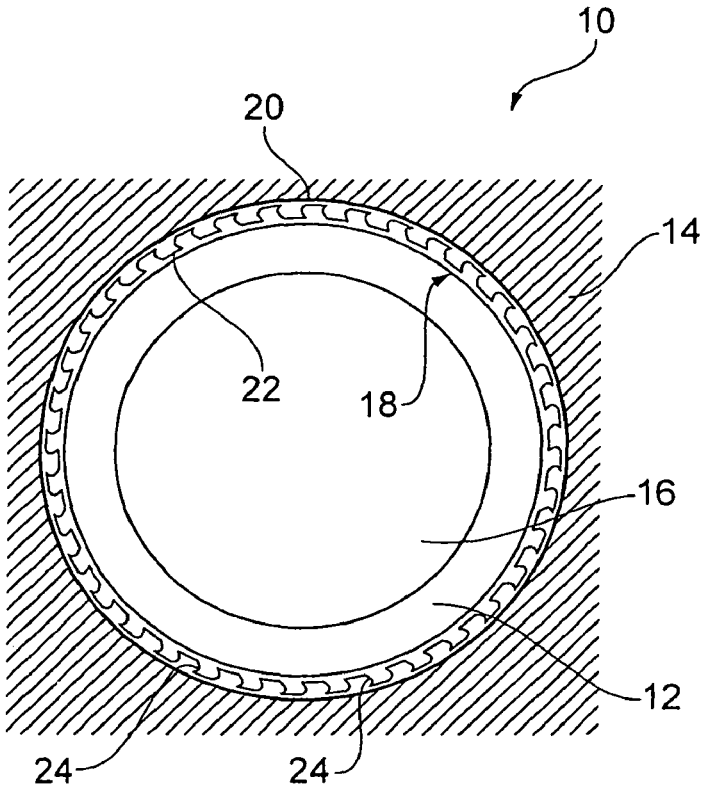
FIG. 1 is a cross-section of an electromagnetic device according to an embodiment of the invention.

FIG. 1 shows an electromagnetic device 10 in the form of a solenoid which forms part of a linear actuator. The solenoid includes an electrical conductor in the form of an elongate cylindrical potted coil 12 which is shown in cross-section in FIG. 1. The potted coil 12 is housed within a corresponding cylindrical bore of a ferromagnetic flux guide 14 in the form of a stator. The inner cylindrical surface of the potted coil 12 defines a space 16 in which a ferromagnetic armature (not shown) can be slidably received, such that energising the coil results in the actuation of the armature from a first position to a second position.

The potted coil 12 comprises a cylindrically coiled electrical conductor which is encapsulated in a ceramic insulating material. The ceramic material is $Al_2O_3$. However, the skilled person will appreciate the invention can be utilised with other ceramics and non-ceramic encapsulants.

As is known in the art, ceramic insulators exhibit superior thermal properties when compared to existing polymeric insulated wiring systems in that they can generally be exposed to higher temperatures without mechanically and electrically degrading. This allows prolonged exposure to high temperature environments without adverse effects on device operation.

However, the use of ceramic potted coils 12 with ferromagnetic flux guides 14 poses difficulties in high temperature environments due to the different thermal expansions in the components. Typical coefficients of thermal expansion for a ferromagnetic flux guide 14 made from silicon steel and an electrically insulating ceramic might be approximately $13.0\times10^{-6}/°$ C. and $6.0\times10^{-6}/°$ C. respectively. Hence, an operating temperature above 250° C. would lead to significant geometric dependent differences in linear and volumetric thermal expansions, particularly in large devices. This results in significant stress at the interface of neighbouring insulating and magnetic components which can lead to premature mechanical and electrical failure of the insulating materials.

The present invention provides an intermediate support structure 18 in the form of an elongate corrugated sleeve 18 at the interface of the potted coil 12 and ferromagnetic flux guide 14. The ridges 20 and troughs 22 (which have been arbitrarily labelled) of the corrugated sleeve extend along the length of the device 10, parallel to the longitudinal axis of the solenoid. In the event of a temperature rise, the corrugated sleeve 18 compresses or expands (depending on the particular configuration, materials and temperatures of the constituent components of the device) in a radial direction so as to allow relative movement between the potted coil 12 and ferromagnetic flux guide 14. Hence, when the device 10 is used in a high temperature environment, the stress at the interface of the potted coil 12 and ferromagnetic flux guide 14 is taken up with the compression or expansion of the corrugated sleeve 18. The reduction of the interfacial stress helps to reduce the mechanical and electrical breakdown of the insulating ceramic which encapsulates the potted coil 12.

Figure 2:
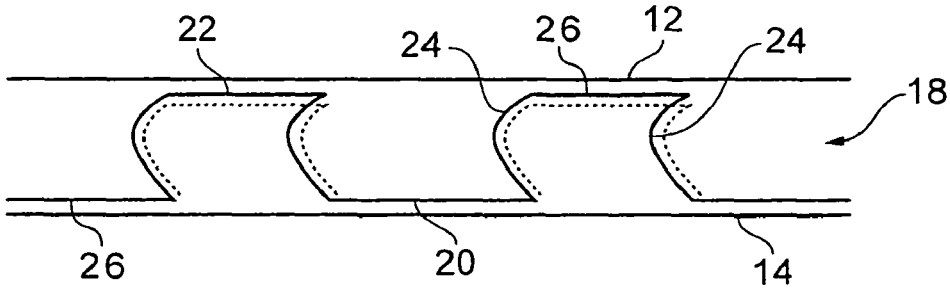
FIG. 2 is an enlarged view of a portion of the intermediate support structure shown in FIG. 1.

As can be seen more clearly in FIG. 2, the ridges 20 and troughs 22 are made up from a plurality of resiliently deformable members 24 and contacting portions 26 which are positioned against the inner circumferential surface of the ferromagnetic flux guide 14 and outer circumferential surface of the potted coil 12.

The resiliently deformable members 24 are in the form of curved plates which extend in an arcuate path between two radially separated points on the outer circumferential surface of the potted coil 12 and the inner circumferential surface of the ferromagnetic flux guide 14, respectively. The curvature of the resiliently deformable member 24 allows for a controlled elastic deformation of the members without buckling or irreversible plastic deformation of the intermediate support structure. Hence, the intermediate support structure 18 to return to its original shape after the device 10 has cooled.

The corrugated sleeve 18 can also act to absorb some of the relative movement between the potted coil 12 and ferromagnetic flux guide 14 when the device 10 experiences high levels of vibration so as to help reduce any resulting mechanical degradation of the potted coil 12.

The resiliently deformable members 24 are connected to each other with contacting portions of the ridges 20 and troughs 22 which alternate between the outer surface of the potted coil 12 and the inner surface of the ferromagnetic flux guide 14, thus forming the corrugated structure. With the exception of the curvature of the resiliently deformable members 24, the corrugations are substantially rectangular in profile which provides the contacting portions 26 with a relatively large contacting surface area. This helps heat to be efficiently conducted away from the potted coil 12 into the ferromagnetic flux guide 14 via the resiliently deformable members 24.

The ridges 20 and troughs 22 of the corrugated structure also provide ducts for cooling 30 of the potted coil 12 with the flow of a fluid. The fluid could be a gas, for example air, or a liquid. Systems for connecting the ducts to a cooling apparatus are known in the art.

The curvature of the resiliently deformable members 24 allows them to be stressed during manufacture of the electromagnetic device 10 such that a pushing force is exerted on the contacting portions 26 to provide a frictional retaining force between the potted coil 12 and ferromagnetic flux guide 14. The frictional retaining force helps centre the potted coil 12 within the ferromagnetic flux guide 14 and prevents axial displacement without the need for other mechanical restraint. However, the skilled person will appreciate that further mechanical restraining means, for example a Belleville washer or wavy-washer, may be desirable in some applications to further retain the device.

As can be seen in FIG. 2, the solid and broken lines of the sleeve 18 show the respective resting and compressed states of two individual corrugations which occur prior to and after a temperature rise. Hence, prior to being exposed to the high temperature environment, the corrugated structure 18 rests in the position indicated by the solid line. After a predetermined temperature rise, the ferromagnetic flux guide 14 and potted coil 12 both expand to varying degrees (depending on the particular construction), thereby compressing the corrugated sleeve 18 to the position of the broken line. The skilled person will appreciate that the compression (or expansion) will depend on the materials and specific constructional dimensions of the device 10.

With this arrangement the corrugated sleeve compresses radially with respect to the coil 12 and there is little or no lateral movement of the between the inner and outer connecting portions of the sleeve 18 and the respective surfaces of the potted coil 12 and ferromagnetic flux guide 14. Thus, any slip related wear and a breakdown between respective surfaces can be reduced so as to preserve the longevity of the electromagnetic device 10.

The sleeve 18 is constructed from titanium which has the corrugations formed in it before being wrapped around the potted coil 12 and inserted into the ferromagnetic flux guide 14. This provides a simple and inexpensive way to construct the electromagnetic device 10. The sleeved construction also allows the potted coil 12 to be only partially surrounded by the sleeve 18 thereby preventing a circumferential conductive path around the potted coil 12. Hence, no parasitic currents (and resultant magnetic fields) are formed in the sleeve 18 during transient or time-varying coil currents.

The intermediate support structure is constructed from titanium so as to provide the desired temperature resistance, mechanical elastic deformation and thermal conductivity to help conduct heat away from the potted coil 12. The sleeve 18 of the present invention is non-magnetic metal, however the skilled person will appreciate that other non-magnetic, or magnetic materials, may be desirable depending on the application of the device 10. The skilled person will also appreciate the dimensions and material of the constituent parts, and the application of the electromagnetic device 10, for example the power and operating temperature, will determine what flexural rigidity and thermal conductivity is required of the intermediate support structure 18.

The resiliently deformable members 24 can take various shapes. In the embodiment of FIGS. 1 and 2 the resiliently deformable members 24 are curved plates. FIGS. 3*a-c* and FIG. 4 show alternative embodiments of the resiliently deformable members 24 and contacting portions 26, of the intermediate support structure 18.

Figure 3:
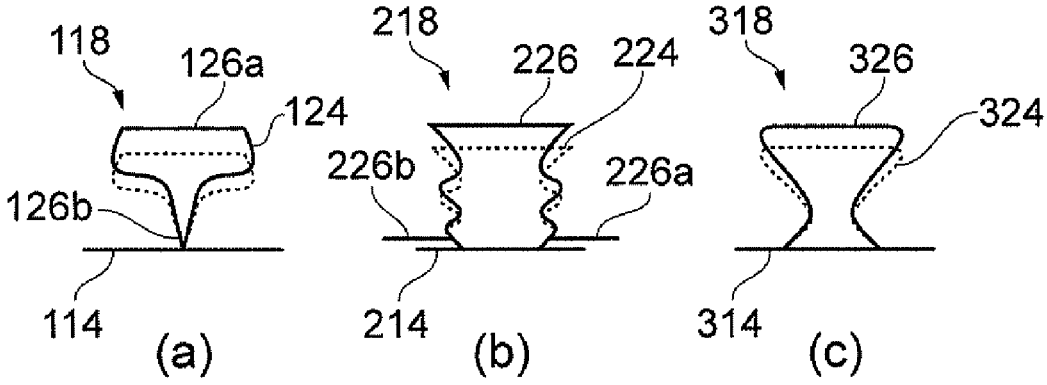
FIGS. 3*a-c* and 4 show alternative embodiments of the intermediate support structure of the invention.

FIG. 3*a* shows an enlarged view of an intermediate support structure 118 having a contacting portion 126*a* for contacting the potted coil which connects to a resiliently deformable member 124 at each end. The resiliently deformable members 124 converge to a single contacting point 126*b* at the ferromagnetic pot flux guide 114 and are curved so as to have a cocktail glass like shape in the cross section. As with the previous embodiment, the solid and broken lines indicate the resting and compressed states of the intermediate support structure 118.

FIG. 3*b* shows a close up view of an intermediate support structure 218 having a contacting portion 226 for contacting the potted coil. The contacting portion 226 connects to a resiliently deformable member 224 at each end in a similar way to the embodiment of FIG. 3*a*. However, the resiliently deformable members 224 shown in FIG. 3*b* do not converge to a single point at the ferromagnetic flux guide 214 as in the embodiment shown in FIG. 3*a*, but each attach to a separate contacting portion 226*a*, 226*b*, which separately abut the ferromagnetic flux guide 214. The resilient deformable members 224 of the embodiment of FIG. 3*b* follow a curved path having multiple radii so as to provide a wavy profile.

The embodiment shown in FIG. 3*c* is similar to the embodiment of FIG. 3*b* with the difference that the resiliently deformable members 324 each follow symmetric, inwardly pointing arcuate paths so as to form a goblet like shape.

The solid and broken lines in FIGS. 3*a-c* show the respective resting and compressed states of each structure prior to and after a temperature rise. Hence, prior to being exposed to the high temperature environment, the structures rest in the positions indicated by the solid lines. After a predetermined temperature rise, the ferromagnetic flux guide 114, 214, 314 and potted coil will both expand to varying degrees, thereby compressing the intermediate support structures 118, 218, 318, in the form of the corrugated sleeve to the position of the broken line. The skilled person will appreciate that the compression (or expansion) will depend on the materials and specific constructional dimensions of the electromagnetic device.

Figure 4:
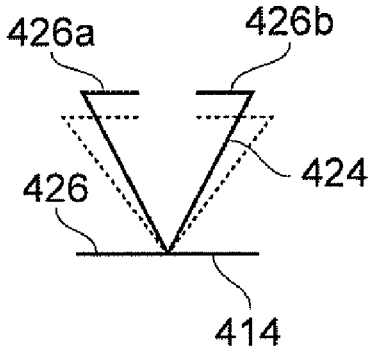

FIG. 4 shows an enlarged portion of an intermediate support structure according to another embodiment of the invention. The resiliently deformable members 424 of this embodiment are straight and project from a common point on the contacting portion 426 of the ferromagnetic flux guide 414 toward the potted coil so as to form a "V" shape. Separate connecting portions 426*a*, 426*b*, for contacting the potted coil 12 are attached to the distal end of each of the resiliently deformable member 424 and extend toward each other. The remote ends of the contacting portions 426*a*, 426*b*, are not connected together so as to have a separating gap above the common contacting point 426 on the ferromagnetic flux guide 414. With this arrangement, the contacting portions 426*a*, 426*b*, on the potted coil 12 are free to laterally displace relative to each with an expansion of the potted coil 12 thereby reducing stress along the length of the resiliently deformable members which may otherwise lead to buckling.

It will be appreciated by the person skilled in the art that the dimensions and materials used for the intermediate support structure will depend on the materials and dimensions of the ferromagnetic flux guide and potted coil, and the application and environment in which the electromagnetic device is employed.

The skilled person will also appreciate that the encapsulating material is not limited to ceramic material but the invention can be implemented in any electromagnetic device which suffers from a thermal expansion mismatch between electrical conductors and surrounding ferromagnetic flux guide.

Although the embodiments described above relate to a linear actuator having an encapsulated cylindrical coil, it will be appreciated that other geometries of encapsulated or non-encapsulated conductor configurations could be used. Indeed, the invention can be applied to any electromagnetic device which suffers from the problems identified throughout the above description. For example, the electromagnetic device might be a motor or other actuator winding such as a pot core. Further, the skilled person will appreciate that the invention can be implemented in electromagnetic sensors as well as actuators.

The invention claimed is:

1. An electromagnetic device, comprising:

a ferromagnetic flux guide;

an insulated electrical conductor entirely encapsulated in an insulating ceramic material, the electrical conductor being positioned adjacent to the ferromagnetic flux guide; and an intermediate support structure positioned between the ferromagnetic flux guide and conductor which includes at least one resiliently deformable member arranged to allow relative movement between the ferromagnetic flux guide and the insulating ceramic material, in which the relative movement is due to thermal expansion or contraction of either or both the ferromagnetic flux guide and insulating ceramic material.

2. The device as claimed in claim 1 wherein the at least one resiliently deformable member extends between the electrical conductor and the ferromagnetic flux guide along an arcuate path.

3. The device as claimed in claim 1 wherein the at least one resiliently deformable members contact the insulated electrical conductor and ferromagnetic flux guide via contacting portions such that heat can flow from the insulated electrical conductor to the ferromagnetic flux guide via the at least one resiliently deformable member.

4. The device as claimed in claim 3 wherein the at least one contacting portion extends between two adjacent resiliently deformable members.

5. The device as claimed in claim 1 wherein the insulated electrical conductor is an encapsulated coil and the intermediate support structure is a sleeve which encircles the either or both the outer or inner circumferential surface of the encapsulated coil.

6. The device as claimed in claim 5 wherein the intermediate support structure substantially extends along the longitudinal length of the coil.

7. The device as claimed in claim 5 wherein the sleeve is of a corrugated construction.

8. The device as claimed in claim 6 wherein ridges and troughs of the corrugated sleeve form ducts for air cooling the encapsulated coil.

9. The device as claimed in claim 5 wherein the at least one resiliently deformable member is stressed so as to exert a force between the ferromagnetic flux guide and encapsulated coil so as to provide a retaining frictional force which prevents axial displacement of the coil.

10. The device as claimed in claim 1 wherein the intermediate support structure is an integral part of the ferromagnetic flux guide.

* * * * *